US011107644B2

(12) United States Patent
Hsieh

(10) Patent No.: US 11,107,644 B2
(45) Date of Patent: Aug. 31, 2021

(54) KEYSWITCH DEVICE

(71) Applicant: DARFON ELECTRONICS CORP., Taoyuan (TW)

(72) Inventor: Ming-Yuan Hsieh, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/898,424

(22) Filed: Jun. 10, 2020

(65) Prior Publication Data

US 2021/0183588 A1 Jun. 17, 2021

(30) Foreign Application Priority Data

Dec. 12, 2019 (TW) ..... 108145574
Mar. 17, 2020 (TW) ..... 109108799

(51) Int. Cl.

| | |
|---|---|
| ***H01H 3/12*** | (2006.01) |
| ***H01H 13/14*** | (2006.01) |
| ***H01H 13/10*** | (2006.01) |
| ***H01H 13/52*** | (2006.01) |
| ***H01H 1/54*** | (2006.01) |

(52) U.S. Cl.

CPC ..... *H01H 3/125* (2013.01); *H01H 1/54* (2013.01); *H01H 13/10* (2013.01); *H01H 13/14* (2013.01); *H01H 13/52* (2013.01); *H01H 2221/04* (2013.01)

(58) Field of Classification Search

CPC ..... H01H 1/54; H01H 13/10; H01H 13/14; H01H 3/125; H01H 36/00; H01H 36/004; H01H 36/0073

USPC ..... 200/5 A, 341; 335/205–207

See application file for complete search history.

(56) References Cited

U.S. PATENT DOCUMENTS

| | | | |
|---|---|---|---|
| 6,572,289 | B2 | 6/2003 | Lo |
| 6,706,985 | B2 | 3/2004 | Chun |
| 7,312,414 | B2 | 12/2007 | Yatsu |
| 9,064,651 | B2 | 6/2015 | Hsu |
| 9,099,261 | B2 | 8/2015 | Hsu |
| 9,343,247 | B2 | 5/2016 | Hsu |
| 9,396,893 | B2 | 7/2016 | Yen |

(Continued)

FOREIGN PATENT DOCUMENTS

| | | | |
|---|---|---|---|
| CN | 103390514 | A | 11/2013 |
| CN | 103681062 | A | 3/2014 |

(Continued)

OTHER PUBLICATIONS

Hsieh, the specification, including the claims, and drawings in the U.S. Appl. No. 16/789,440, filed Feb. 13, 2020.

*Primary Examiner* — Edwin A. Leon
*Assistant Examiner* — Iman Malakooti
(74) *Attorney, Agent, or Firm* — Winston Hsu

(57) ABSTRACT

A keyswitch device includes a cap, a board, a first returning member, and a second returning member. The board is disposed opposite to the cap. The first returning member is disposed between the cap and the board and includes a magnet member and a magnetic member for providing a magnetic force. The second returning member is disposed between the cap and the board for providing an elastic force. When the cap is released at a lowest position, the cap moves upward via the elastic member and then arrives and stays at a highest position via the magnetic force.

17 Claims, 15 Drawing Sheets

(56) References Cited

U.S. PATENT DOCUMENTS

| | | | | |
|---|---|---|---|---|
| 9,412,535 | B2 | 8/2016 | Hsu | |
| 9,508,505 | B2 | 11/2016 | Hsu | |
| 9,837,220 | B2 | 12/2017 | Hou | |
| 9,953,776 | B2 | 4/2018 | Liao | |
| 9,959,991 | B2 | 5/2018 | Chen | |
| 9,966,202 | B2 | 5/2018 | Liao | |
| 9,984,840 | B2 | 5/2018 | Hsu | |
| 10,008,345 | B2 | 6/2018 | Hsu | |
| 10,026,566 | B1 * | 7/2018 | Chen | H01H 13/705 |
| RE47,957 | E | 4/2020 | Liao | |
| 2012/0268384 | A1 | 10/2012 | Peterson | |
| 2015/0047959 | A1 | 2/2015 | Wu | |
| 2016/0329174 | A1 | 11/2016 | Chen | |
| 2016/0351349 | A1 | 12/2016 | Chen | |
| 2017/0178841 | A1 * | 6/2017 | Hsu | H01H 3/12 |
| 2017/0278650 | A1 | 9/2017 | Chen | |
| 2018/0025856 | A1 | 1/2018 | Liao | |
| 2019/0035581 | A1 | 1/2019 | Yang | |
| 2019/0155401 | A1 | 5/2019 | Chen | |
| 2020/0105485 | A1 | 4/2020 | Yang | |

FOREIGN PATENT DOCUMENTS

| | | | | |
|---|---|---|---|---|
| CN | 104051175 | A | 9/2014 | |
| CN | 104319142 | A | 1/2015 | |
| CN | 103745860 | B | 11/2015 | |
| CN | 106803469 | B | 12/2018 | |
| CN | 208819783 | U | 5/2019 | |
| JP | 2004127908 | | 4/2004 | |
| TW | M410967 | U1 | 9/2011 | |
| TW | M416801 | U1 | 11/2011 | |
| TW | M484179 | U | 8/2014 | |
| TW | I475585 | B | 3/2015 | |
| TW | I523058 | B | 2/2016 | |
| TW | I555050 | B | 10/2016 | |
| TW | 201640545 | A | 11/2016 | |
| TW | M552663 | U | 12/2017 | |
| TW | I625749 | B | 6/2018 | |
| TW | I628685 | * | 7/2018 | H01H 13/7065 |
| TW | I636474 | B | 9/2018 | |
| TW | 201919080 | A | 5/2019 | |
| TW | I663621 | B | 6/2019 | |
| TW | I669738 | B | 8/2019 | |
| TW | I671773 | B | 9/2019 | |
| TW | I674601 | B | 10/2019 | |
| TW | I674607 | B | 10/2019 | |
| TW | I677892 | | 11/2019 | |
| TW | I681430 | B | 1/2020 | |

* cited by examiner

KEYSWITCH DEVICE

BACKGROUND OF THE INVENTION

1. Field of the Invention

The present invention relates to a keyswitch device, and more specifically, to a keyswitch device utilizing a first returning member and a second returning member for providing a magnetic force and an elastic force respectively to a cap.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

A conventional keyswitch usually adopts the design that an elastic member is disposed between a cap and a board. Accordingly, when the cap is pressed by a user, the elastic member provides the cap with an elastic force for driving the cap return to a non-pressed position with movement of a support device (e.g. a scissor support mechanism). Because the elastic member is usually made of rubber material, elastic fatigue of the elastic member may occur after the elastic member is used over a long period of time so as to shorten the life of the keyswitch. Furthermore, the elastic member occupies more internal space due to its excessive height, so as to be disadvantageous to the thinning design of the keyswitch.

The prior art adopts a magnetic design to replace the elastic member. For example, the magnetic design involves disposing two magnetic members on the board and a support member of the support device respectively for generating a magnetic force. As such, when the cap is pressed by an external force to make the two magnetic members away from each other, the cap moves to a pressed position together with the support device. When the cap is released, the magnetic force drives the two magnetic members to approach each other for moving the cap back to the non-pressed position together with the support device. However, the aforesaid design usually causes the problem that the cap cannot move back to the non-pressed position since the magnetic force is too weak when the cap is pressed to make the two magnetic members away from each other.

SUMMARY OF THE INVENTION

The present invention provides a keyswitch. The keyswitch device includes a cap, a board, a first returning member, and a second returning member. The board is disposed opposite to the cap. The first returning member is disposed between the cap and the board. The first returning member includes a magnet member and a magnetic member for providing a magnetic force. The second returning member is disposed between the cap and the board for providing an elastic force. When the cap is released at a lowest position, the cap moves upward via the elastic force and then arrives and stays at a highest position via the magnetic force.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
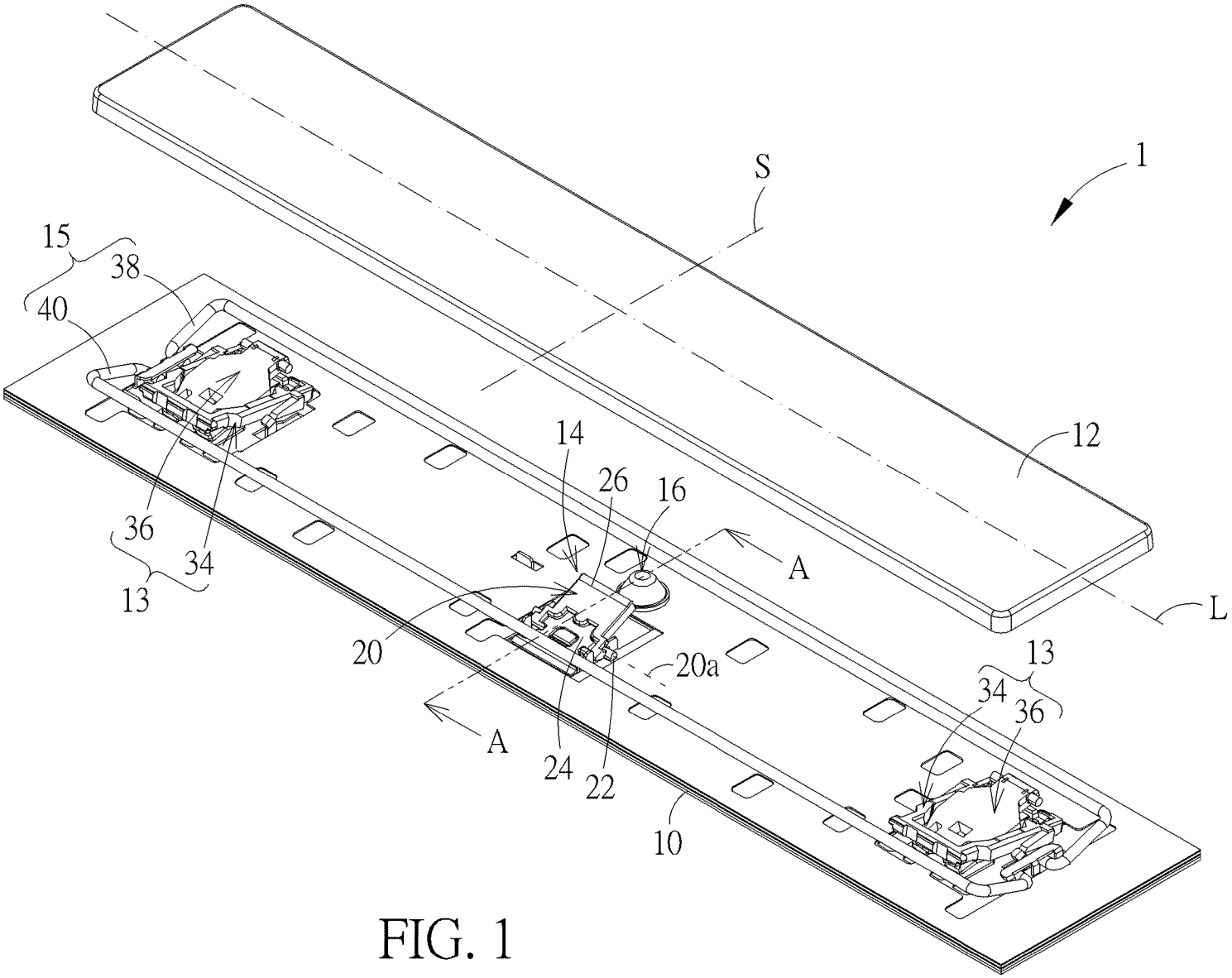
FIG. 1 is a partial exploded diagram of a keyswitch device according to an embodiment of the present invention.
Figure 2:
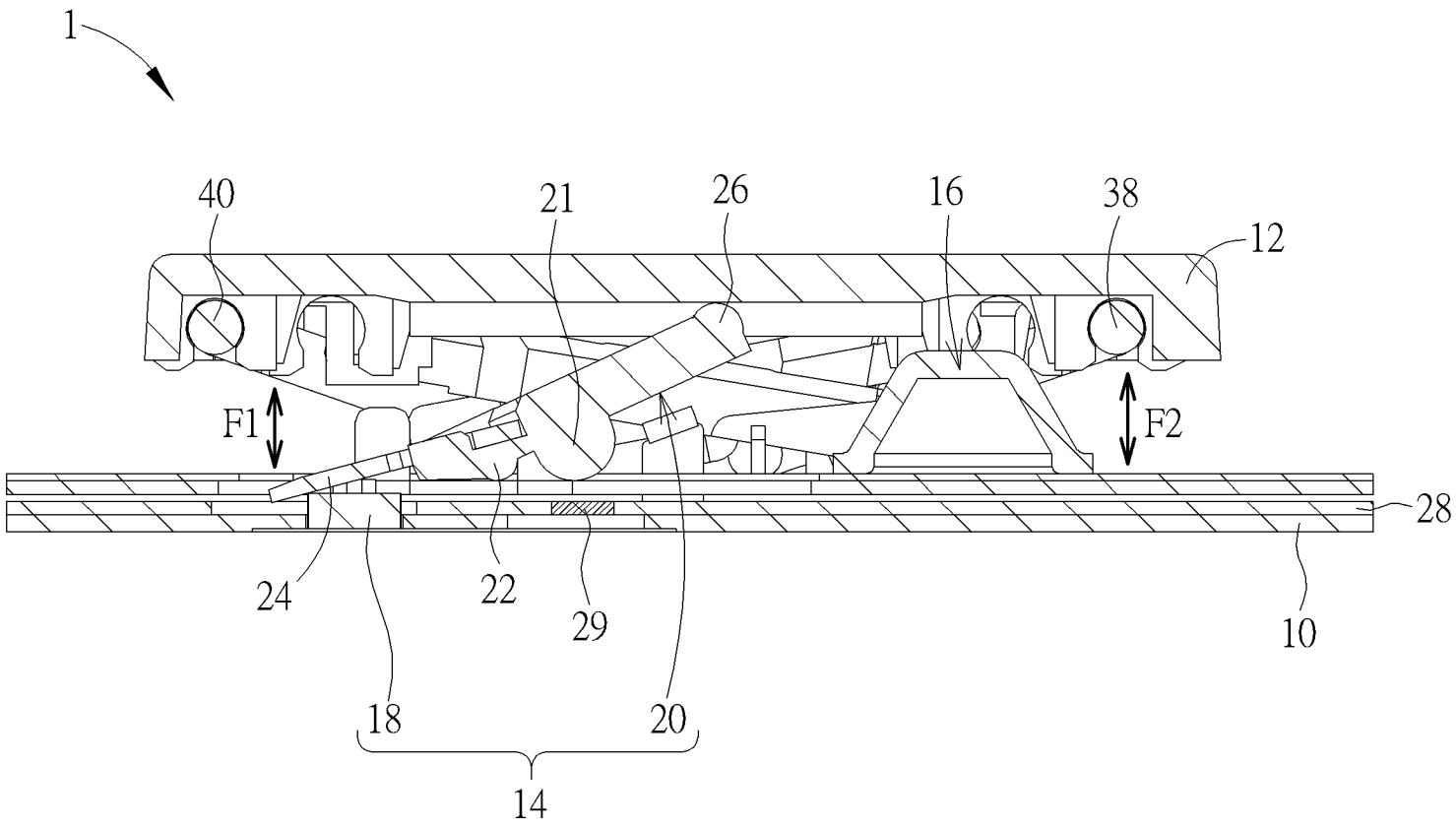
FIG. 2 is a cross-sectional diagram of the keyswitch device in FIG. 1 along a cross-sectional line A-A.

Please refer to FIG. 1 and FIG. 2. FIG. 1 is a partial exploded diagram of a keyswitch device 1 according to an embodiment of the present invention. FIG. 2 is a cross-sectional diagram of the keyswitch device 1 in FIG. 1 along a cross-sectional line A-A. For clearly showing the structural design that a first returning member 14 is disposed on a board 10, a main support structure 11 is omitted in FIG. 1. As shown in FIG. 1 and FIG. 2, the keyswitch device 1 could be preferably a large sized key (e.g. a space key, but not limited thereto) having a long axis L and a short axis S. The keyswitch device 1 includes the board 10, a cap 12, the first returning member 14, and a second returning member 16. The board 10 is disposed opposite to the cap 12. The first returning member 14 and the second returning member 16 are disposed between the board 10 and the cap 12. The first returning member 14 includes a magnet member 18 and a magnetic member 20 (e.g. metal) for providing a magnetic force, and the second returning member 16 provides an elastic force. Accordingly, when the cap 12 is pressed to a lowest position and then released, the cap 12 can move upward via the elastic force provided by the second returning member 16, and can arrive and stay at a highest position steadily via the magnetic force provided by the first returning member 14 for a user to press.

In this embodiment, the magnetic member 20 has a pivot portion 22, a magnetic portion 24 and a driving portion 26. The pivot portion 22 passes through the magnetic member 20 to extend from two lateral surfaces of the magnetic member 20 respectively. The magnetic portion 24 and the driving portion 26 are located at two sides of the pivot portion 22. The magnetic member 20 is rotatably disposed on the board 10 via the pivot portion 22 relative to an axial direction 20*a* (parallel to the long axis L). The magnet member 18 is disposed on the board 10 and is located under the magnetic portion 24. A magnetic force F1 (depicted as a double arrow in FIG. 2) is generated between the magnetic portion 24 and the magnet member 18. The second returning member 16 could be preferably a rubber dome and could be located at a side of the first returning member 14 on the short axis S for providing an elastic force F2 (depicted as a double arrow in FIG. 2), but not limited thereto. That is, in another embodiment, the present invention could adopt the design that the second returning member is a spring for providing a linear returning force, and the related description could be reasoned by analogy according to the following description and omitted herein.

Figure 3:
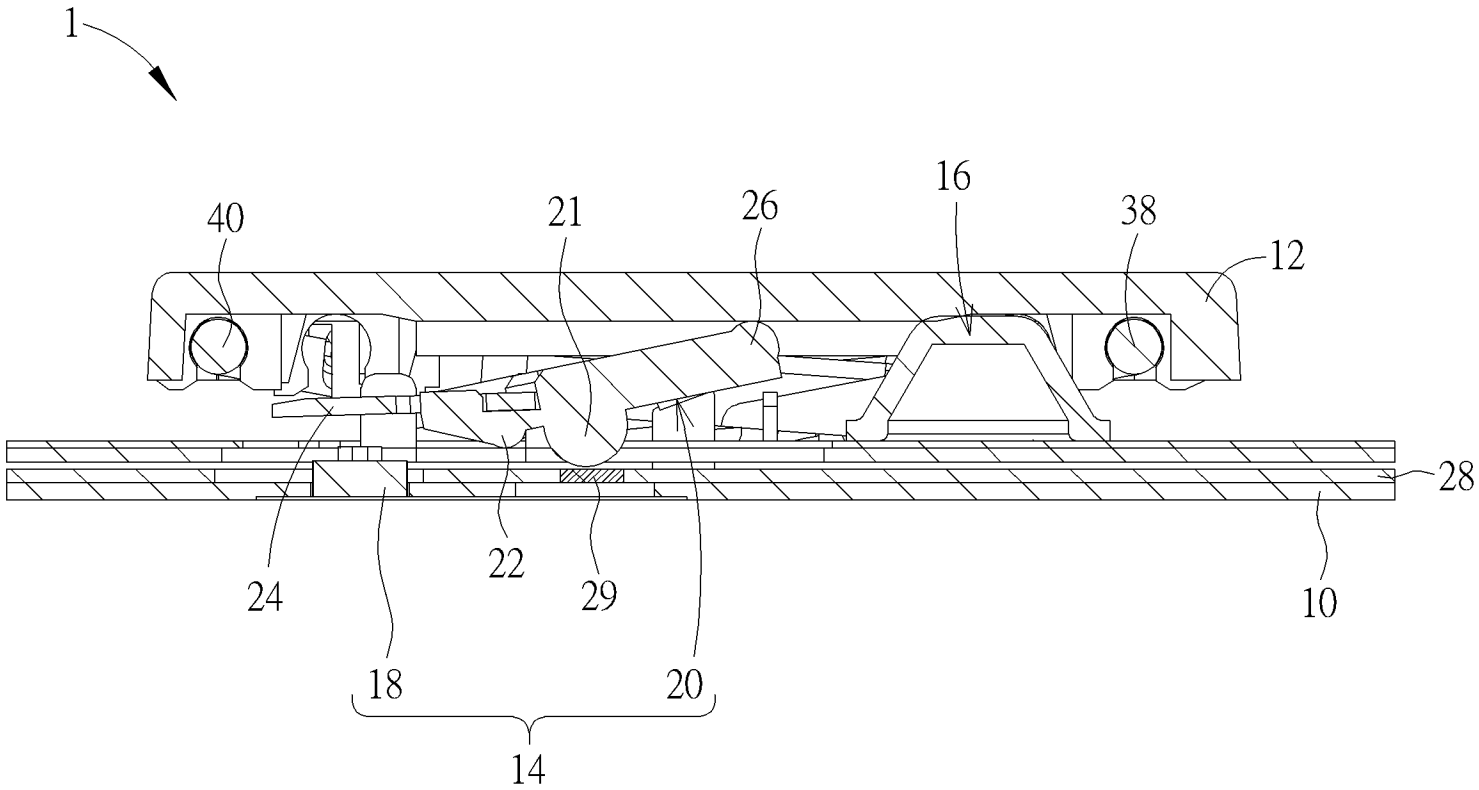
FIG. 3 is a cross-sectional diagram of a cap in FIG. 2 being pressed to be in contact with a second returning member.
Figure 4:
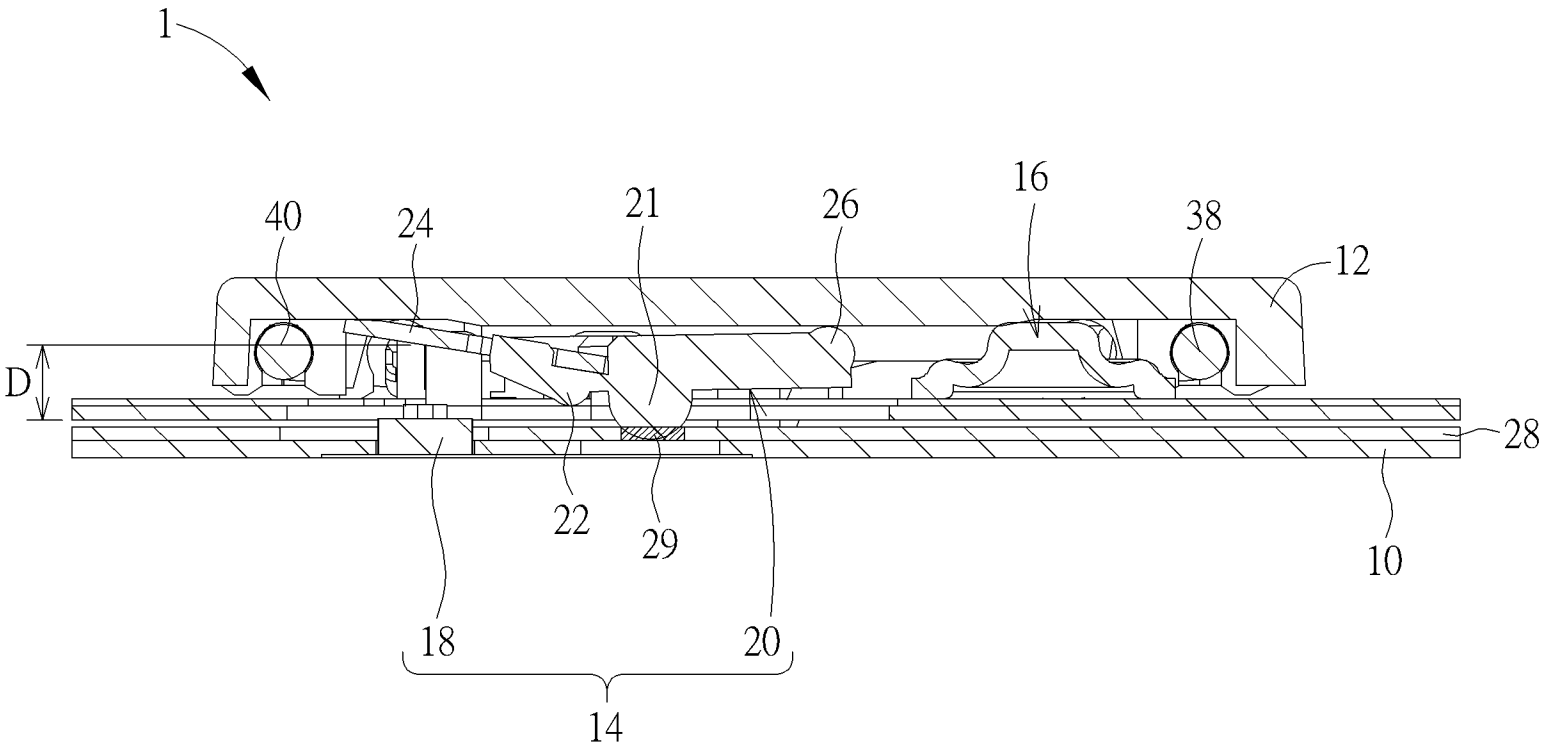
FIG. 4 is a cross-sectional diagram of the cap in FIG. 3 being pressed to the lowest position.
Figure 5:
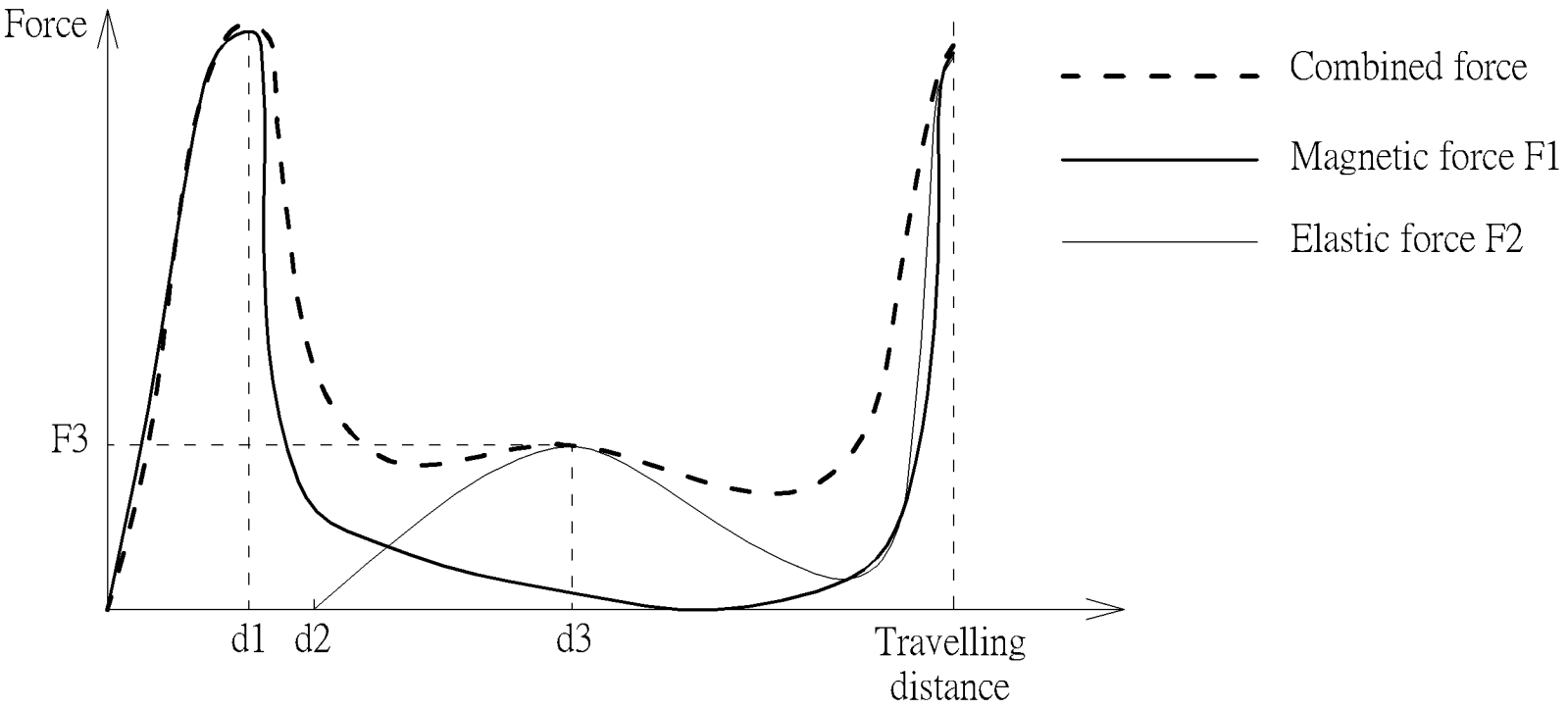
FIG. 5 is a curved line chart of a magnetic force, an elastic force and a travelling distance of the cap in FIG. 2.

More detailed description for the pressing operation of the keyswitch device 1 is provided as follows. Please refer to FIG. 1, FIG. 2, FIG. 3, FIG. 4 and FIG. 5. FIG. 3 is a cross-sectional diagram of the cap 12 in FIG. 2 being pressed to be in contact with the second returning member 16. FIG. 4 is a cross-sectional diagram of the cap 12 in FIG. 3 being pressed to the lowest position. FIG. 5 is a curved line chart of the magnetic force F1, the elastic force F2 and a travelling distance of the cap 12 in FIG. 2. As shown in FIGS. 1-4, when the cap 12 is not pressed, the magnetic portion 24 is in contact with the magnet member 18 to generate the magnetic force F1 for keeping the cap 12 at the highest position as shown in FIG. 2 (at this time, the second returning member 16 has not been pressed by the cap 12 to deform yet). When the cap 12 is pressed by an external force to move a distance d1 and the external force is enough to overcome the magnetic force F1 to separate the magnetic portion 24 from the magnet member 18 via the driving portion 26, the magnetic portion 24 rotates upward via the pivot portion 22 to move the cap 12 downward from the highest position as shown in FIG. 2. During this process, as shown in FIG. 5, the magnetic force F1 is reduced gradually and the cap 12 moves a distance d2 to be in contact with the second returning member 16. At this time, elastic deformation of the second returning member 16 can occur to generate the elastic force F2 for driving the cap 12 to return to its original position.

In other words, when the cap 12 moves a distance d3 to the lowest position to make the second returning member 16 have a maximum deformation and the magnetic portion 24 is spaced apart from the magnet member 18 at a maximum distance D (as shown in FIG. 4), the elastic force F2 provided by the second returning member 16 can be combined with the gradually-reduced magnetic force F1 to generate a combined force F3 (as shown in FIG. 5) for driving the cap 12 back to its original position when the distance between the magnetic portion 24 and the magnet member 18 is gradually increased, so as to provide an automatic cap returning function. To be noted, the keyswitch device 1 could further include a circuit board 28, and the magnetic member 20 could further have a protruding point 21. The circuit board 28 has a switch 29 corresponding to the protruding point 21. Accordingly, when the cap 12 is pressed to the lowest position, the protruding point 21 can trigger the switch 29 with pivoting of the magnetic member 20 for performing a corresponding input function.

When the external force is released, the combined force F3 can drive the cap 12 to move upward for rotating the magnetic portion 24 downward via the pivot portion 22 (during this process, the magnetic force F1 is gradually increased due to the gradually-reduced distance between the magnetic portion 24 and the magnet member 18, and the elastic force F2 is gradually decreased due to the gradually-reduced deformation of the second returning member 16), so as to move the cap 12 from the lowest position as shown in FIG. 4 upward to the highest position as shown in FIG. 2. In such a manner, the keyswitch device 1 can provide an automatic cap returning function for a user to perform the subsequent input operations conveniently.

Via the aforesaid design that the second returning member can provide the elastic force for driving the cap back to its original position when the magnetic member of the first returning member is spaced apart from the magnet at the maximum distance, the present invention can efficiently solve the prior art problem that the cap cannot move back to the non-pressed position due to the weak magnetic force caused by the two magnetic members being away from each other, so as to greatly improve the press feedback of the keyswitch device.

Figure 6:
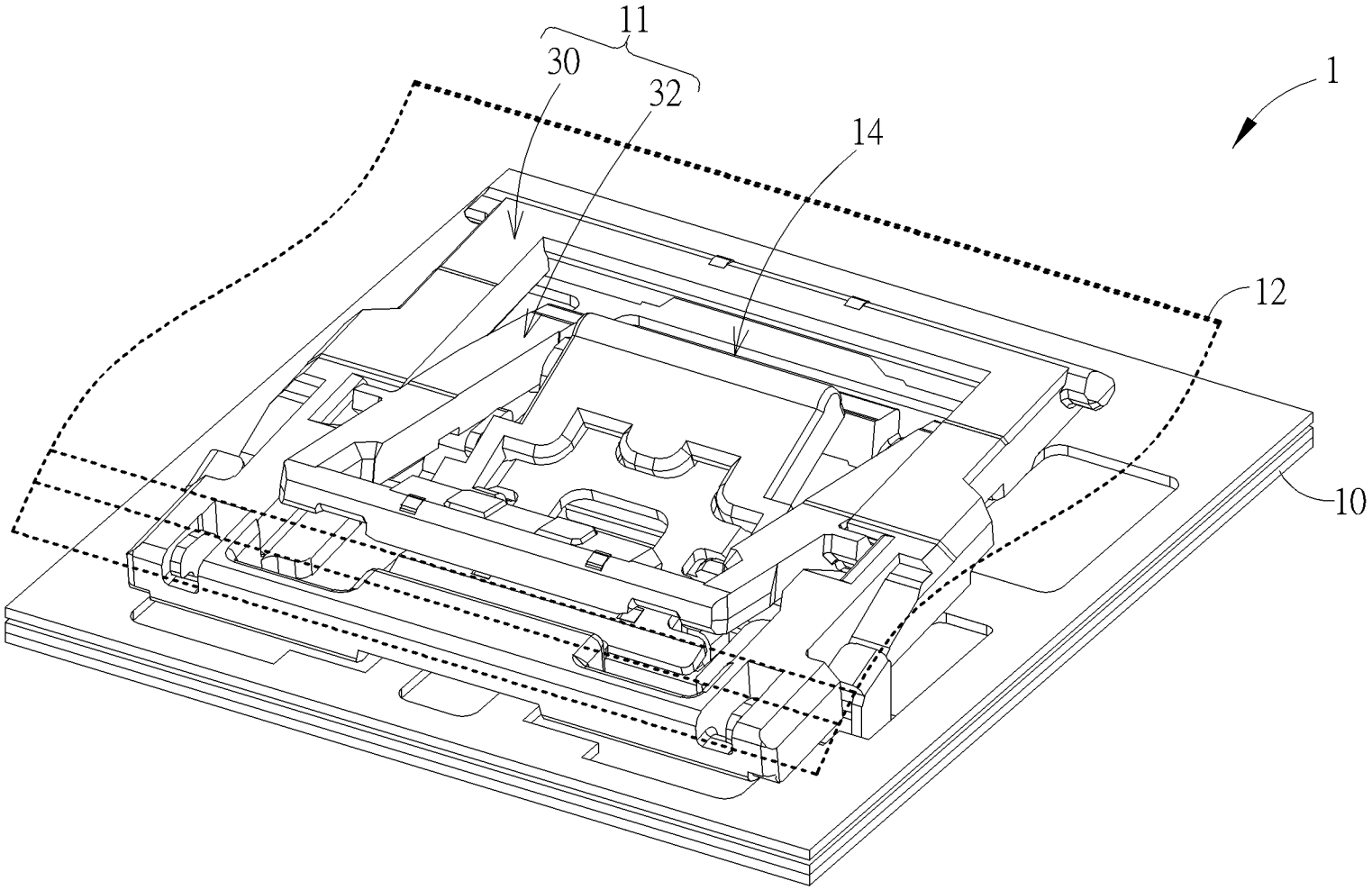
FIG. 6 is an enlarged diagram of a first returning member and a main support structure in FIG. 1 being disposed on a board.

In practical application, the present invention can adopt a main support structural design. For example, please refer to FIG. 1 and FIG. 6. FIG. 6 is an enlarged diagram of the first returning member 14 and the main support structure 11 in FIG. 1 being disposed on the board 10. For clearly showing the structural designs of the first returning member 14 and the main support structure 11, the cap 12 is briefly depicted by dotted lines in FIG. 6. As shown in FIG. 1 and FIG. 6, the keyswitch device 1 could further include the main support structure 11. The main support structure 11 preferably adopts a scissor support structural design and includes a first main frame 30 and a second main frame 32. The first returning member 14 is disposed between the first main frame 30 and the second main frame 32. The first main frame 30 and the second main frame 32 pivotably intersect with each other and are movably connected between the board 10 and the cap 12, so as to make upward and downward movement of the cap 12 steadier. As for the related description for the connection design that the first main frame 30 and the second main frame 32 are movably connected to the board 10 and the cap 12 (e.g. the connection design that the first main frame 30 and the second main frame 32 could have pivotal shafts to be pivoted to the board 10 and the cap 12 respectively), it could be commonly seen in the prior art and omitted herein.

Furthermore, the present invention could adopt an auxiliary support structural design which could be preferably selected from a scissor support structural design or a link bar structural design. For example, as shown in FIG. 1, the keyswitch device 1 could further include at least one auxiliary support structure 13 (two auxiliary support structures 13 disposed at two sides of the main support structure 11 respectively along the long axis L as shown in FIG. 1, but not limited thereto) and an auxiliary support structure 15. The auxiliary support structure 13 preferably adopts a scissor support structural design and includes two auxiliary frames 34, 36. The two auxiliary frames 34, 36 pivotably intersect with each other and are movably connected between the board 10 and the cap 12. The auxiliary support structure 15 preferably adopts a link bar structural design and includes two auxiliary frames 38, 40. In this embodiment, the two auxiliary frames 38, 40 could be preferably a U-shaped round bar (but not limited thereto) and could be movably connected between the board 10 and the cap 12 and opposite to each other. Accordingly, via the support connection of the main support structure 11 and the auxiliary support structures 13, 15, the present invention can make upward and downward movement of the cap 12 relative to the board 10 steadier and efficiently improve the motion synchronization of the cap 12. As for the related description for the connection design that the auxiliary support structures 13, 15 are movably connected to the board 10 and the cap 12 (e.g. the connection design that the auxiliary frames 34, 36 could have pivotal shafts to be pivoted to the board 10 and the cap 12 respectively), it could be commonly seen in the prior art and omitted herein.

Figure 7:
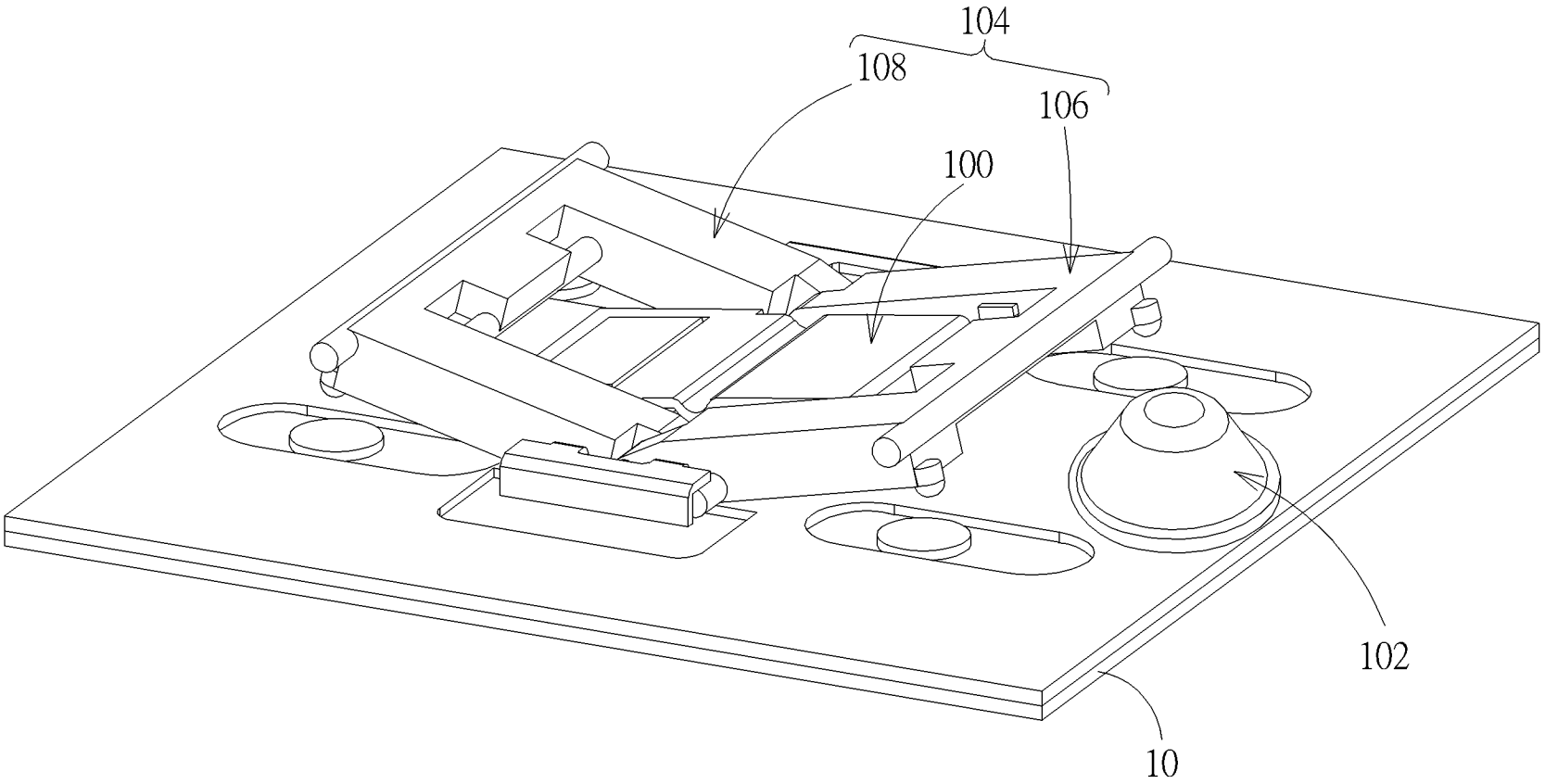
FIG. 7 is an enlarged diagram of a first returning member, a second returning member, and a main support structure being disposed on the board according to another embodiment of the present invention.

Moreover, the main support structural design of the present invention is not limited to the scissor support structural design. For example, please refer to FIG. 7, which is an enlarged diagram of a first returning member 100, a second returning member 102, and a main support structure 104 being disposed on the board 10 according to another embodiment of the present invention. Components both mentioned in this embodiment and the aforesaid embodiments represent components with similar structures or functions. The structural designs of the first returning member 100 and the second returning member 102 are similar to the structural designs of the first returning member 14 and the second similar member 16 mentioned in the aforesaid embodiments. That is, the first returning member 100 adopts the design that the magnet member and the magnetic member are opposite to each other for providing the magnetic force, and the second returning member 102 adopts the flexible structural design for providing the elastic force. The related description could be reasoned by analogy according to the aforesaid embodiments and omitted herein. In this embodiment, as shown in FIG. 7, the main support structure 104 preferably adopts a butterfly support structural design and includes a first main frame 106 and a second main frame 108. The first main frame 106 and the second main frame 108 are slidably connected to the cap 12 (not shown in FIG. 7) and pivoted to the board 10. The first main frame 106 and the second main frame 108 are opposite to each other. Accordingly, via the V-shaped support of the first main frame 106 and the second main frame 108, upward and downward movement of the cap 12 relative to the board 10 can be steadier. The butterfly support structural design mentioned in this embodiment could be also applied to the auxiliary support structure of the present invention. That is, the auxiliary support structures adopted by the present invention could be selected from at least one of the scissor support structure, the butterfly structure and the link bar structure for improving the motion steadiness and synchronization of the cap.

Figure 8:
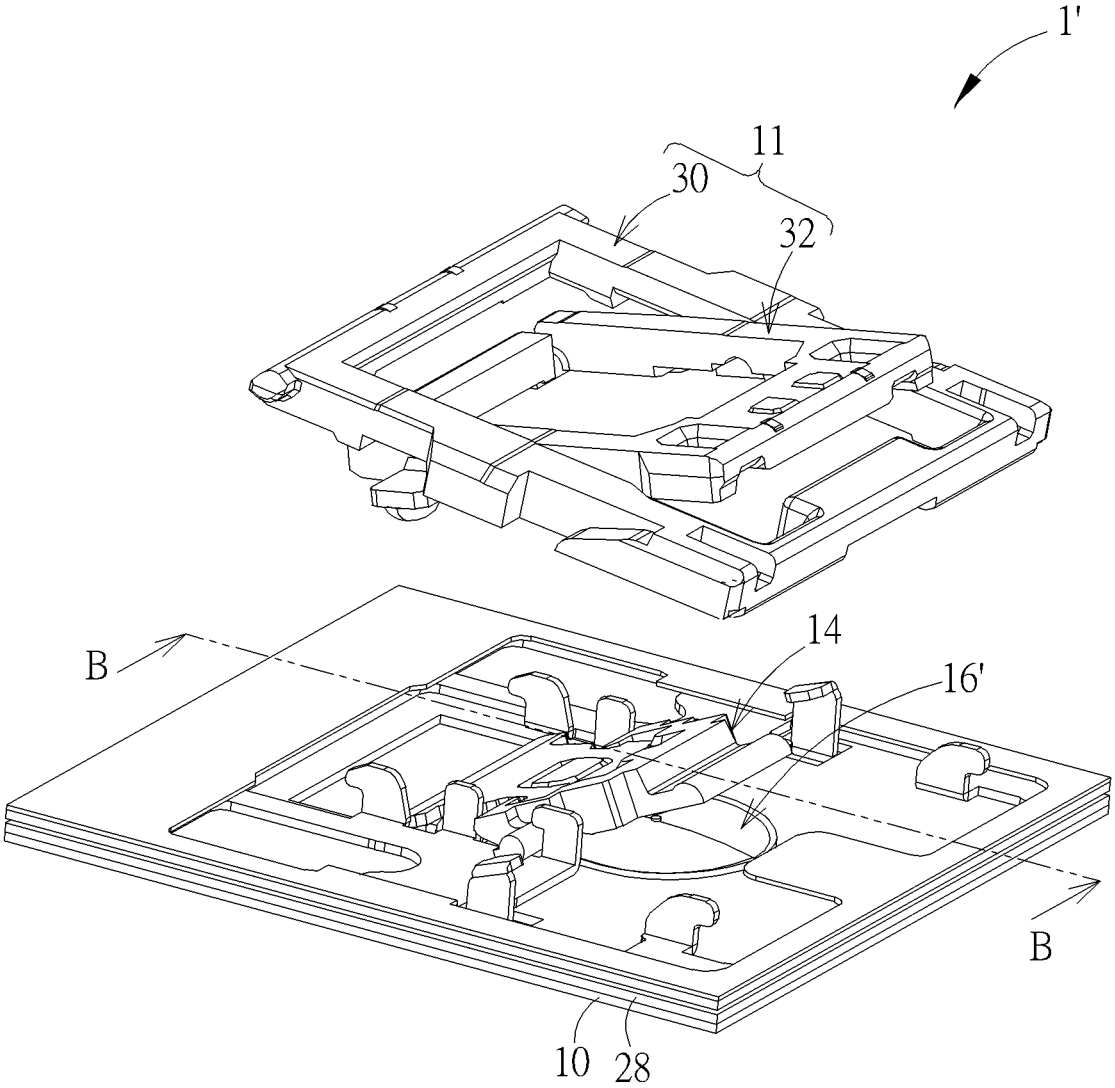
FIG. 8 is a partial exploded diagram of a keyswitch device according to another embodiment of the present invention.
Figure 9:
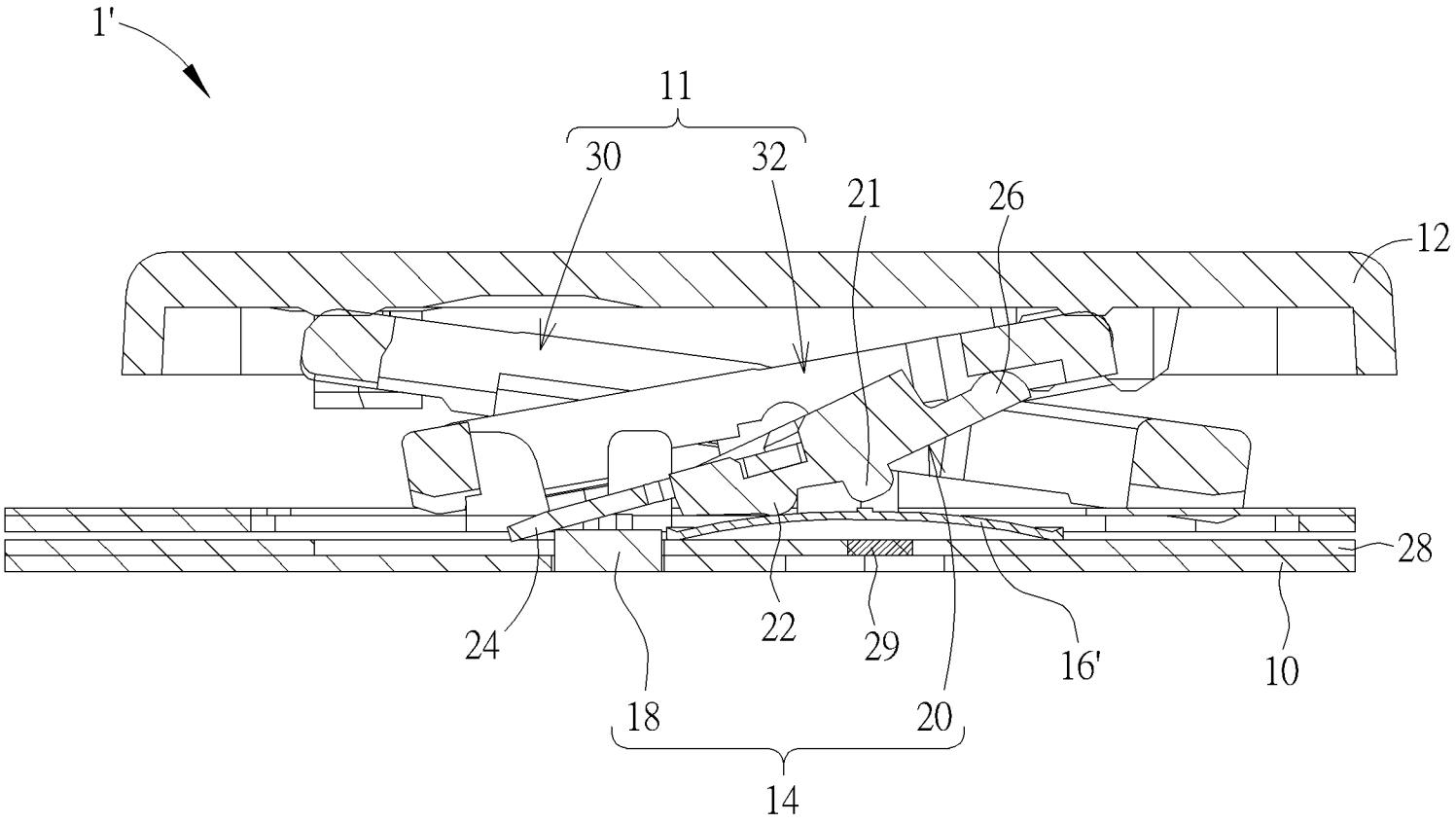
FIG. 9 is a cross-sectional diagram of the keyswitch device in FIG. 8 along a cross-sectional line B-B.

To be noted, the present invention could adopt the design that the second returning member is disposed between the first returning member and the board. For example, please refer to FIG. 8 and FIG. 9. FIG. 8 is a partial exploded diagram of a keyswitch device 1' according to another embodiment of the present invention. FIG. 9 is a cross-sectional diagram of the keyswitch device 1' in FIG. 8 along a cross-sectional line B-B. Components both mentioned in this embodiment and the aforesaid embodiments represent components with similar structures or functions. As shown in FIG. 8 and FIG. 9, the keyswitch device 1' includes the board 10, the main support structure 11, the cap 12 (not shown in FIG. 8), the first returning member 14, a second returning member 16', and the circuit board 28. In this embodiment, the second returning member 16' could be a metal dome disposed on the circuit board 28 corresponding to the switch 29 (but not limited thereto, meaning that the second returning member 16 could be an elastic pad or an elastic pillar in another embodiment). Accordingly, during the process of the cap 12 being pressed to the lowest position to make the protruding point 21 of the magnetic member 20 trigger the switch 29 via the metal dome, the elastic force generated by deformation of the metal dome can be combined with the gradually-reduced magnetic force to generate a combined force for returning the cap 12 to its original position. The detailed description could be reasoned by analogy according to the aforesaid embodiments and omitted herein.

Figure 10:
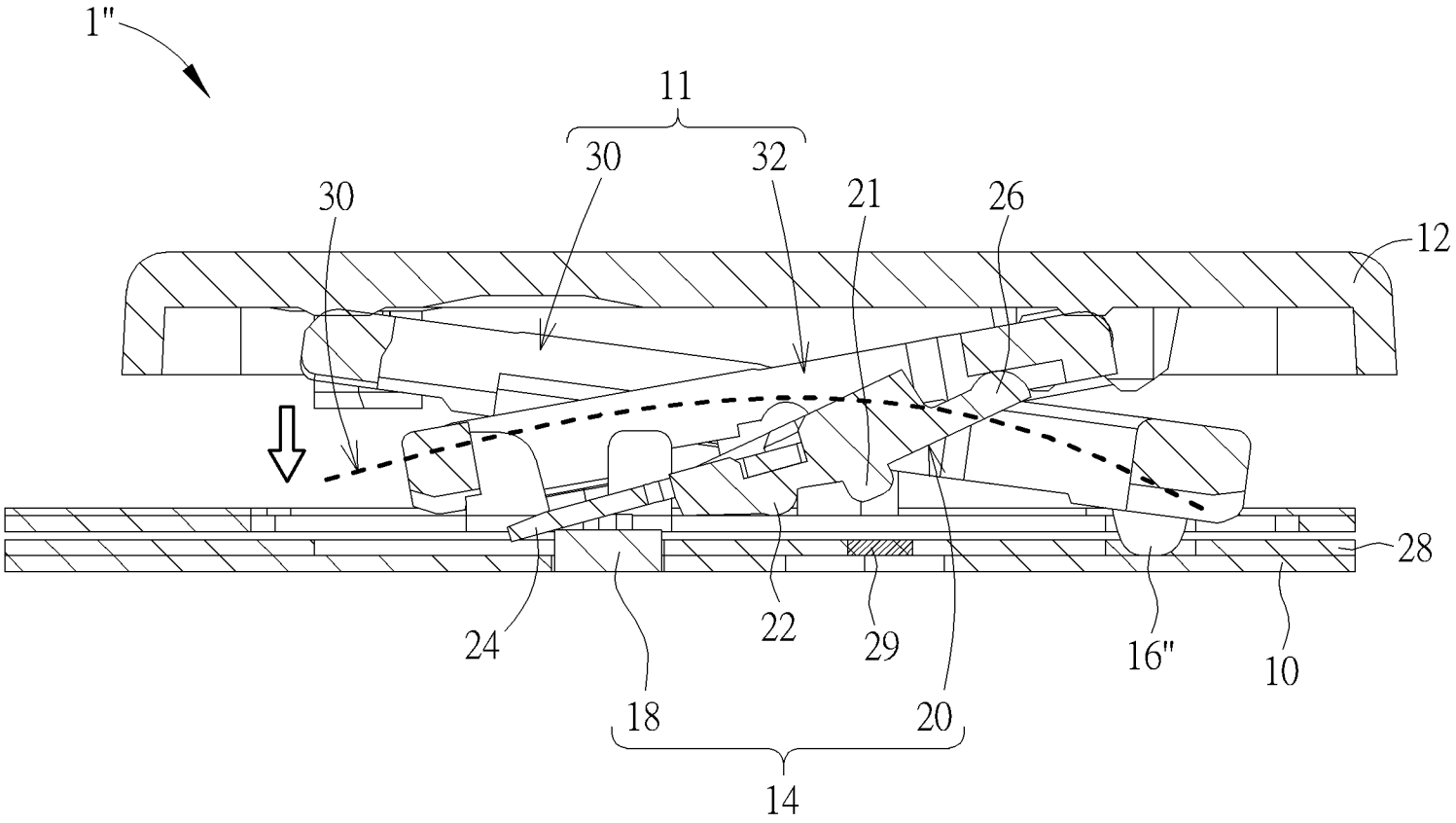
FIG. 10 is a cross-sectional diagram of a keyswitch device according to another embodiment of the present invention.
Figure 11:
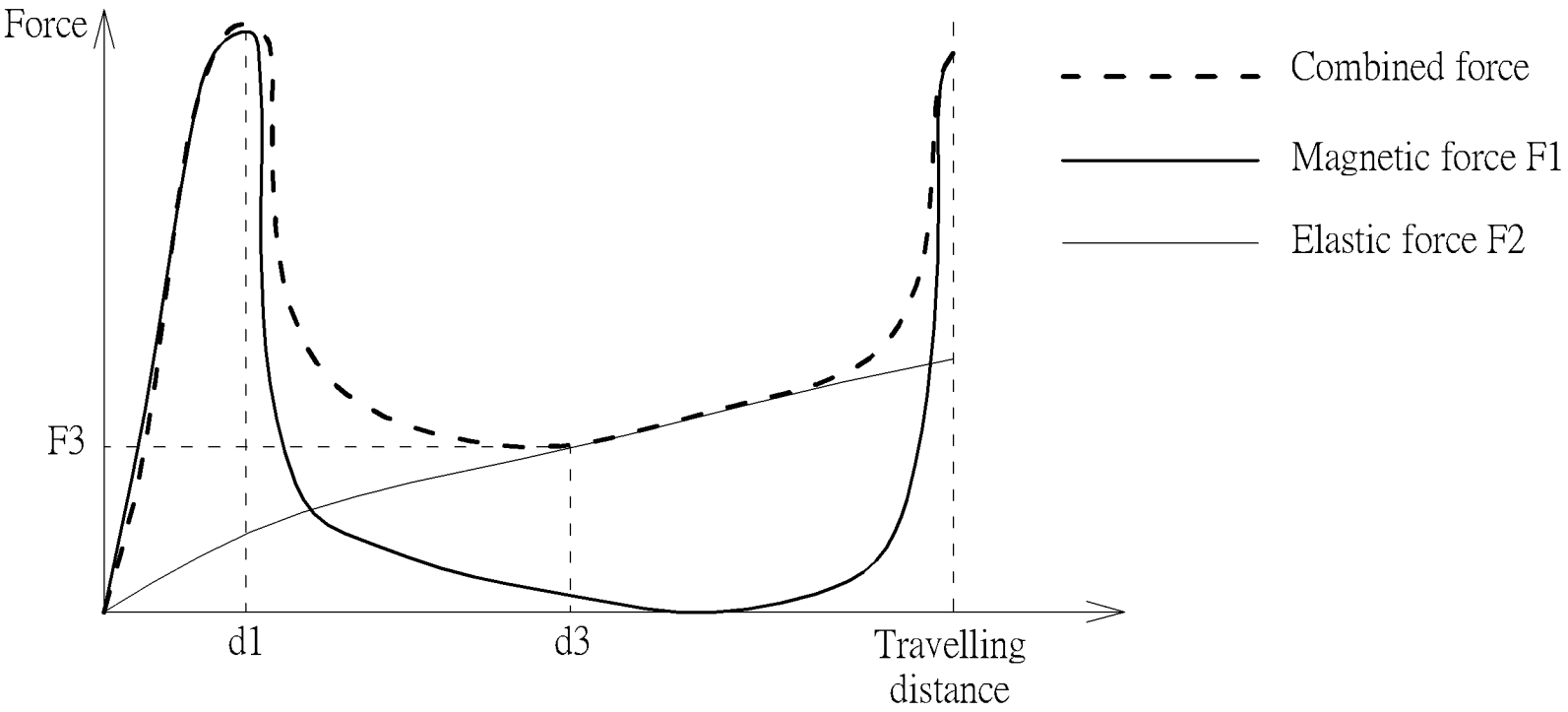
FIG. 11 is a curved line chart of the magnetic force, the elastic force and a travelling distance of the cap in FIG. 10.

In another embodiment, the present invention could adopt the design that the second returning member is formed on the support structure to abut against the board. For example, please refer to FIG. 10 and FIG. 11. FIG. 10 is a cross-sectional diagram of a keyswitch device 1" according to another embodiment of the present invention. FIG. 11 is a curved line chart of the magnetic force F1, the elastic force F2 and a travelling distance of the cap 12 in FIG. 10. Components both mentioned in this embodiment and the aforesaid embodiments represent components with similar structures or functions. As shown in FIG. 10 and FIG. 11, the keyswitch device 1" includes the board 10, the main support structure 11, the cap 12, the first returning member 14, a second returning member 16", and the circuit board 28. In this embodiment, the second returning member 16" could be a protruding point protruding from the first main frame 30 toward the board 10. Accordingly, during the process of the cap 12 being pressed to the lowest position to make the protruding point 21 of the magnetic member 20 trigger the switch 29, the second returning member 16" abuts against the board 10 to make the first main frame 30 structurally interfere with the board 10 for deforming the first main frame 30 (deformation of the first main frame 30 is briefly depicted by bold dotted lines in FIG. 10) to generate the elastic force. As such, the elastic force generated by deformation of the first main frame 30 can be combined with the gradually-reduced magnetic force to generate a combined force for returning the cap 12 to its original position. The relationship between the combined force and the travelling distance of the cap 12 could be as shown in FIG. 11, and the detailed description could be reasoned by analogy according to FIG. 5 and omitted herein.

The forming position of the protruding point could be not limited to FIG. 10. For example, the second returning member could be a protruding point protruding from the second main frame toward the board to abut against the board during the process of the cap being pressed for making the second main frame structurally interfere with the board, so as to cause deformation of the second main frame to generate the elastic force. In another embodiment, the second returning member could be protruding points respectively protruding from the first main frame and the second main frame toward the board to abut against the board during the process of the cap being pressed for making the first and second main frames structurally interfere with the board, so as to cause deformation of the first and second main frames to generate the elastic force. In another embodiment, the second returning member could be a protruding point protruding from the first main frame toward the cap to abut against the cap during the process of the cap being pressed for making the first main frame structurally interfere with the cap, so as to cause deformation of the first main frame to generate the elastic force. As for the related description for other derived embodiments (i.e. the designs utilizing the protruding point formed on the support structure to abut against the other structures of the keyswitch device for causing deformation of the support structure, such as the design that the second returning member is a protruding point protruding from the second main frame toward the cap or a protruding point protruding from the auxiliary structure toward the cap or the board), it could be reasoned by analogy according to FIG. 10 and omitted herein.

Figure 12:
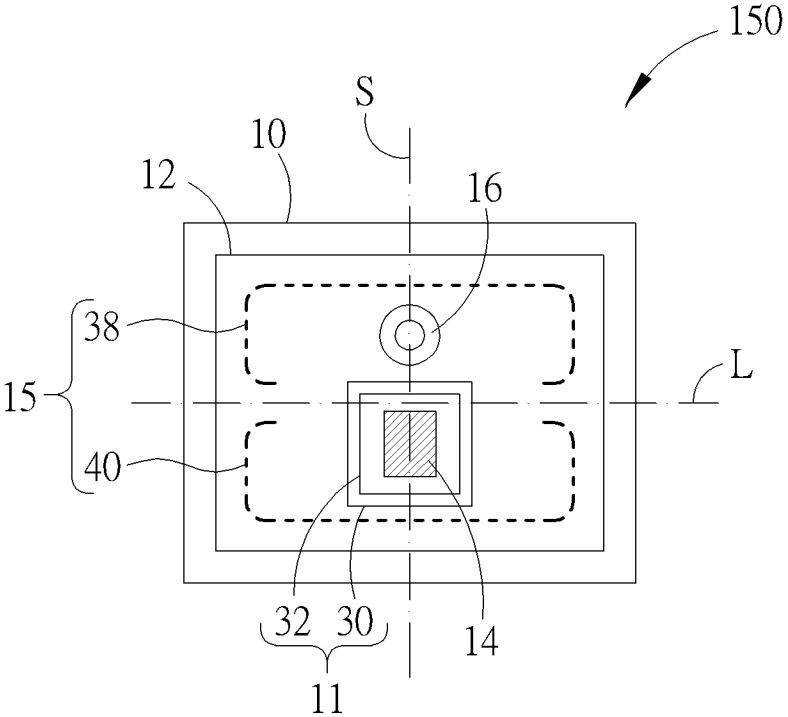
FIG. 12 is a top view of a keyswitch device according to another embodiment of the present invention.

It should be mentioned that configuration of the first returning member, the second returning member, the main support structure, and the auxiliary support structure is not limited to the aforesaid embodiments. That is, the designs in which the second returning member is utilized to provide the elastic force for returning the cap to its original position when the magnetic member and the magnet member are spaced apart from each other at the maximum distance may fall within the scope of the present invention. For example, please refer to FIG. 12, which is a top view of a keyswitch device 150 according to another embodiment of the present invention. As shown in FIG. 12, the keyswitch device 150 includes the board 10, the cap 12, the first returning member 14, the second returning member 16, the main support structure 11, and the auxiliary support structure 15. Components both mentioned in this embodiment and the aforesaid embodiments represent components with similar structures or functions. For clearly showing configuration of the first returning member 14, the second returning member 16, the main support structure 11 and the auxiliary support structure 15, the first returning member 14 is briefly depicted as a rectangle pattern, the second returning member 16 is briefly depicted as a round pattern, the main support structure 11 is briefly depicted as a rectangle pattern, and the auxiliary support structure 15 is depicted by dotted lines in FIG. 10. As shown in FIG. 12, the keyswitch device 150 omits the auxiliary support structure 13 to simplify the structural design of the keyswitch device 150 and efficiently reduce the overall volume of the keyswitch device 150 for being flexibly applied to a larger-sized key (e.g. a space key) or a smaller-sized key (e.g. a number key).

Figure 13:
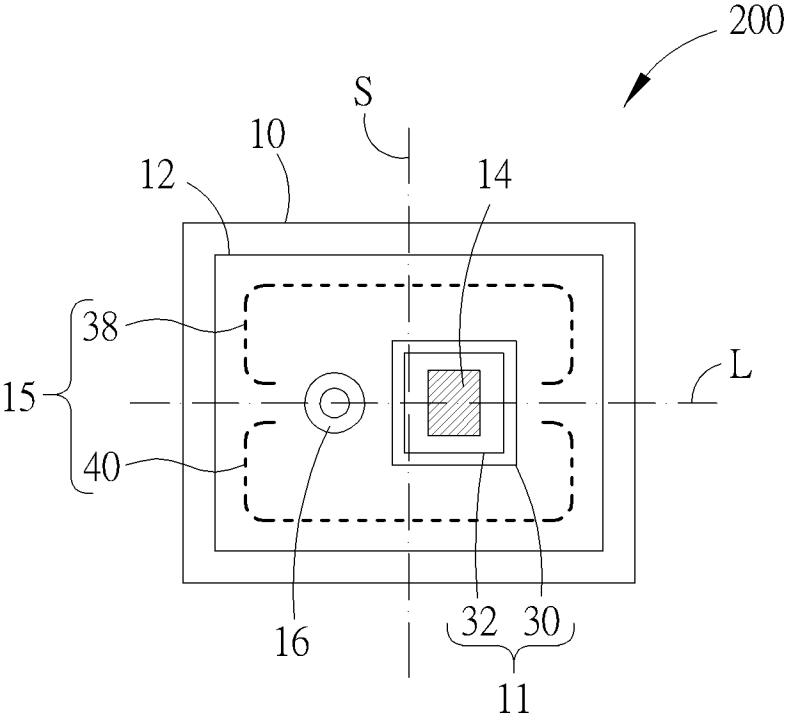
FIG. 13 is a top view of a keyswitch device according to another embodiment of the present invention.

In another embodiment, please refer to FIG. 13, which is a top view of a keyswitch device 200 according to another embodiment of the present invention. As shown in FIG. 13, the keyswitch device 200 includes the board 10, the cap 12, the first returning member 14, the second returning member 16, the main support structure 11, and the auxiliary support structure 15. Components both mentioned in this embodiment and the aforesaid embodiments represent components with similar structures or functions. As shown in FIG. 13, in this embodiment, the second returning member 16 is disposed at a side of the first returning member 14 on the long axis L for providing the elastic force to the cap 12.

Figure 14:
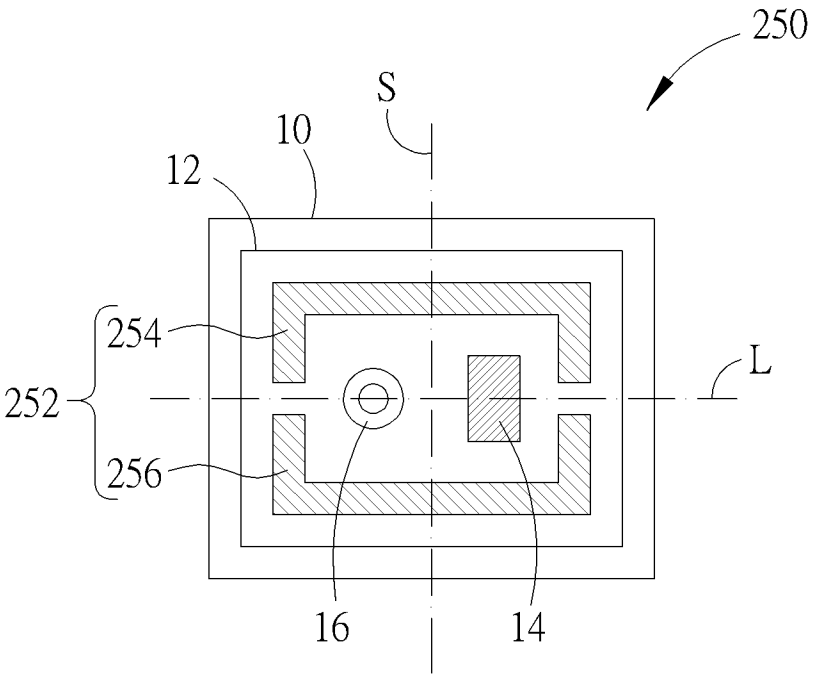
FIG. 14 is a top view of a keyswitch device according to another embodiment of the present invention.

In another embodiment, please refer to FIG. 14, which is a top view of a keyswitch device 250 according to another embodiment of the present invention. As shown in FIG. 14, the keyswitch device 250 includes the board 10, the cap 12, the first returning member 14, the second returning member 16, and a main support structure 252. Components both mentioned in this embodiment and the aforesaid embodiments represent components with similar structures or functions. The main support structure 252 is briefly depicted as a bent bold line pattern. In this embodiment, as shown in FIG. 14, the keyswitch device 250 omits the auxiliary support structure and only adopts the one single support design that the main support structure 252 includes two plate frames 254, 256 opposite to each other (but not limited thereto, meaning that the present invention could adopt the flat link bar design to replace the round link rod design mentioned in the aforesaid embodiment) for further simplifying the structural design of the keyswitch device 250. The plate frames 254, 256 selectively adopt the scissor or butterfly support structural design, and the related description can be reasoned by analogy according to FIGS. 6-7 and omitted herein.

Figure 15:
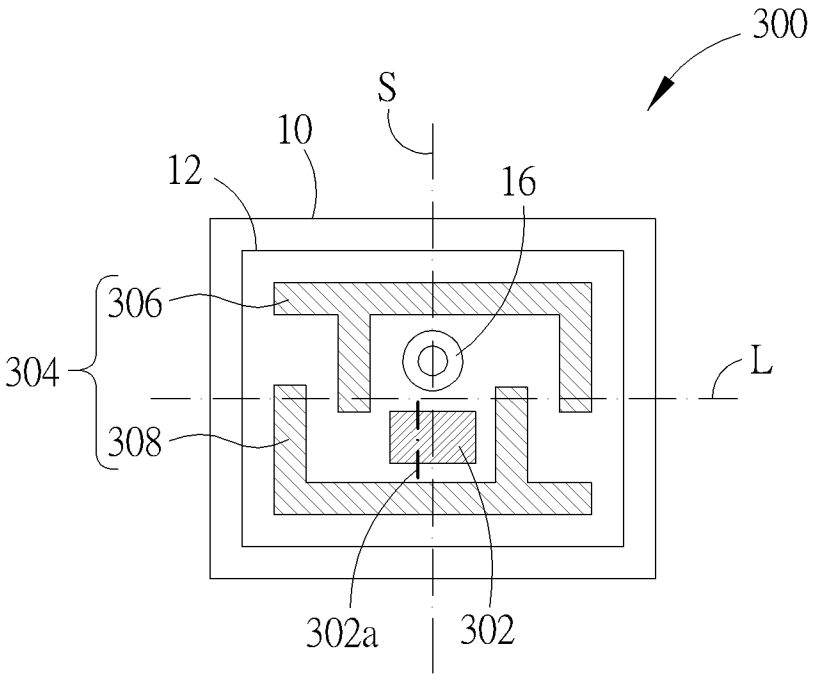
FIG. 15 is a top view of a keyswitch device according to another embodiment of the present invention.

In another embodiment, please refer to FIG. 15, which is a top view of a keyswitch device 300 according to another embodiment of the present invention. As shown in FIG. 15, the keyswitch device 300 includes the board 10, the cap 12, a first returning member 302, the second returning member 16, and a main support structure 304. Components both mentioned in this embodiment and the aforesaid embodiments represent components with similar structures or functions. In FIG. 15, the first returning member 302 is briefly depicted as a rectangle pattern, and the main support structure 304 is briefly depicted as a bent bold line pattern. In this embodiment, as shown in FIG. 15, the first returning member 302 is rotatably disposed on the board 10 relative to an axial direction 302*a* (parallel to the short axis S) for providing the magnetic force to the cap 12, and the main support structure 304 includes plate frames 306, 308 opposite to each other (but not limited thereto, meaning that the present invention could adopt the flat link bar design to replace the round link rod design mentioned in the aforesaid embodiment) for further simplifying the structural design of the keyswitch device 300. The plate frames 306, 308 selectively adopt the scissor or butterfly support structural design, and the related description can be reasoned by analogy according to FIGS. 6-7 and omitted herein.

Figure 16:
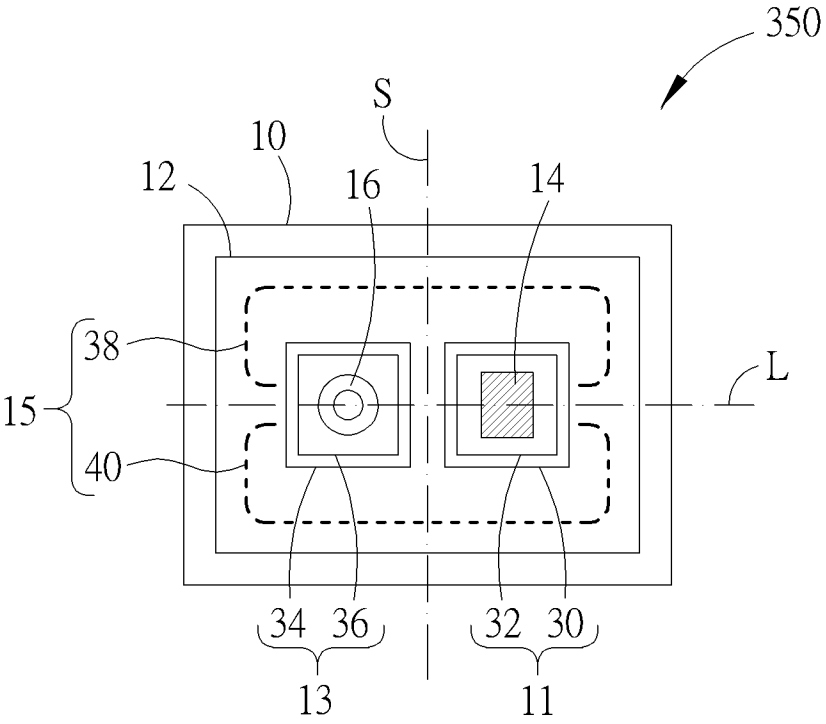
FIG. 16 is a top view of a keyswitch device according to another embodiment of the present invention.

In another embodiment, please refer to FIG. 16, which is a top view of a keyswitch device 350 according to another embodiment of the present invention. As shown in FIG. 16, the keyswitch device 350 includes the board 10, the cap 12, the first returning member 14, the second returning member 16, the main support structure 11, the auxiliary support structure 13, and the auxiliary support structure 15. Components both mentioned in this embodiment and the aforesaid embodiments represent components with similar structures or functions. As shown in FIG. 16, the second returning member 16 (e.g. a rubber dome or a spring) is disposed between the two auxiliary frames 34, 36 of the auxiliary support structure 13 for providing the elastic force to the cap 12.

Figure 17:
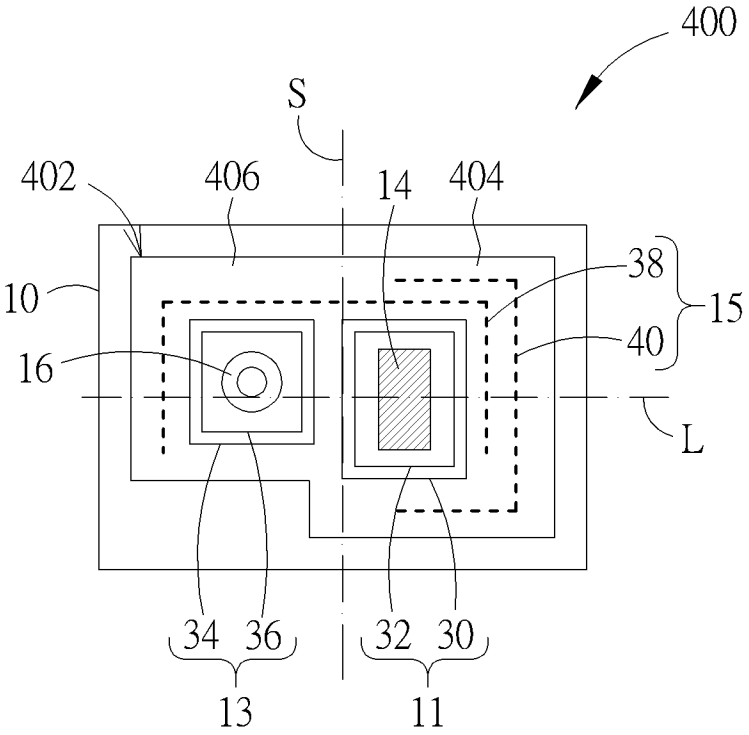
FIG. 17 is a top view of a keyswitch device according to another embodiment of the present invention.

In another embodiment, please refer to FIG. 17, which is a top view of a keyswitch device 400 according to another embodiment of the present invention. As shown in FIG. 17, the keyswitch device 400 includes the board 10, a cap 402, the first returning member 14, the second returning member 16, the main support structure 11, the auxiliary support structure 13, and the auxiliary support structure 15. Components both mentioned in this embodiment and the aforesaid embodiments represent components with similar structures or functions. As shown in FIG. 17, the cap 402 has the long axis L, the short axis S, a first pressed region 404, and a second pressed region 406. An area of the first pressed region 404 is larger than an area of the second pressed region 406 to make the cap 402 inverted L-shaped (but not limited thereto). The main support structure 11 is disposed on the board 10 corresponding to the first pressed region 404. The first returning member 14 is disposed between the first main frame 30 and the second main frame 32 of the main support structure 11 for providing the magnetic force to the cap 402. Furthermore, the auxiliary support structure 13 is disposed on the board 10 corresponding to the second pressed region 406. The second returning member 352 is disposed between the auxiliary frames 34, 36 of the auxiliary support structure 13 for providing the elastic force to the cap 402. The auxiliary frame 38 of the auxiliary support structure 15 is transversely disposed in the first pressed region 404 and the second pressed region 406 along the long axis L and is movably connected to the board 10 and the cap 402, and the auxiliary frame 40 of the auxiliary support structure 15 is transversely disposed in the first pressed region 404 along the short axis S and is movably connected to the board 10 and the cap 402. As such, not only the motion synchronization and the structural strength of the cap 402 on the long axis L can be enhanced via the auxiliary frame 38, but the motion synchronization and the structural strength of the cap 402 corresponding to the first pressed region 404 can be also enhanced via the auxiliary frame 40.

Figure 18:
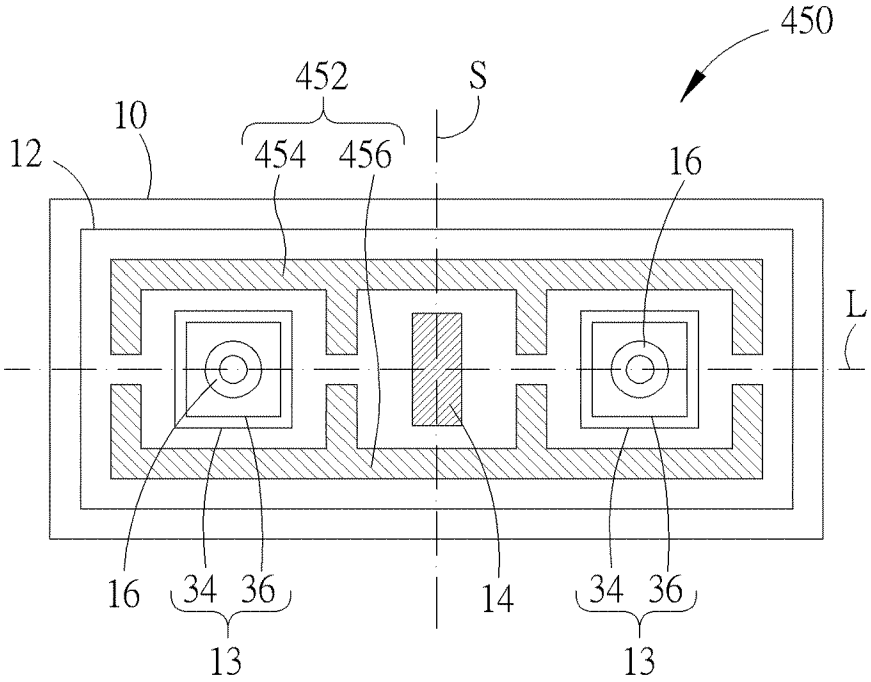
FIG. 18 is a top view of a keyswitch device according to another embodiment of the present invention.

In another embodiment, please refer to FIG. 18, which is a top view of a keyswitch device 450 according to another embodiment of the present invention. As shown in FIG. 18, the keyswitch device 450 includes the board 10, the cap 12, the first returning member 14, the second returning member 16, a main support structure 452, and the two auxiliary support structures 13. Components both mentioned in this embodiment and the aforesaid embodiments represent components with similar structures or functions. In FIG. 18, the main support structure 452 is briefly depicted as a bent bold line pattern. In this embodiment, as shown in FIG. 18, the main support structure 452 includes plate frames 454, 456 opposite to each other (but not limited thereto, meaning that the present invention could adopt the flat link bar design to replace the round link rod design mentioned in the aforesaid embodiment). The plate frames 454, 456 selectively adopt the scissor or butterfly support structural design, and the related description can be reasoned by analogy according to FIGS. 6-7 and omitted herein. In addition, the two auxiliary support structures 13 are disposed at the two sides of the first returning member 14 along the long axis L respectively, and the two second returning members 352 (e.g. rubber domes or springs) are disposed between the auxiliary frames 34, 36 of the two auxiliary support structures 13 respectively for providing the elastic force to the cap 12.

Figure 19:
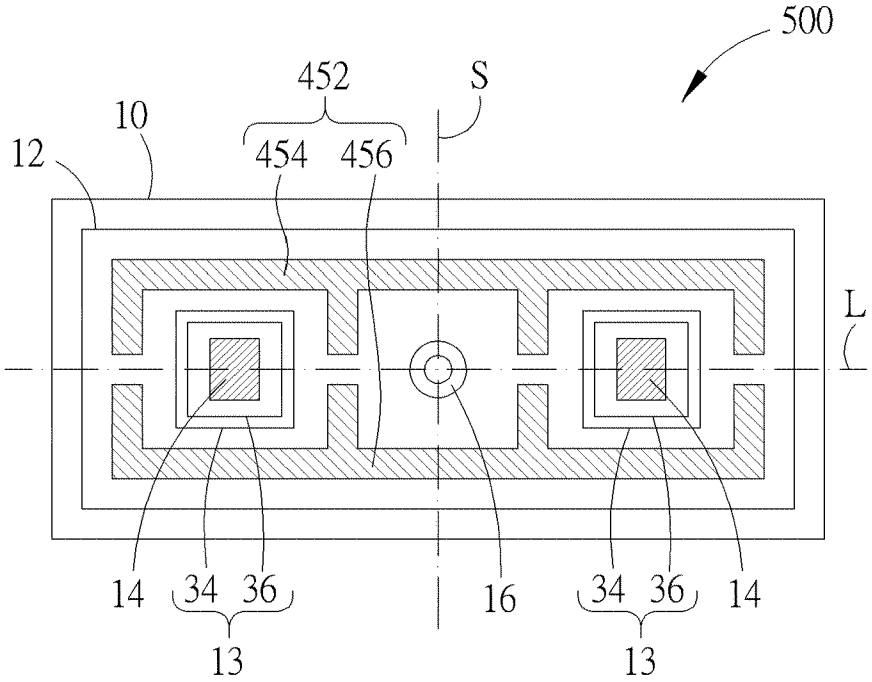
FIG. 19 is a top view of a keyswitch device according to another embodiment of the present invention.

In another embodiment, please refer to FIG. 19, which is a top view of a keyswitch device 500 according to another embodiment of the present invention. As shown in FIG. 19, the keyswitch device 500 includes the board 10, the cap 12, the two first returning members 14, the second returning member 16, the main support structure 452, and the two auxiliary support structures 13. Components both mentioned in this embodiment and the aforesaid embodiments represent components with similar structures or functions. As shown in FIG. 19, the second returning member 16 is disposed at a middle position on the board corresponding to the cap 12, the two auxiliary support structures 13 are disposed at the two sides of the second returning member 16, and the two first returning members 14 are disposed between the auxiliary frames 34, 36 of the two auxiliary support structures 13 respectively for providing the magnetic force to the cap 12.

As for the related description for other derived designs (e.g. the linear returning force design, the design that the second returning member is disposed between the first returning member and the board, the scissor or butterfly support design and so on) applicable to the keyswitch device 150, 200, 250, 300, 350, 400, 450 and 500, it could be reasoned by analogy according to the aforesaid embodiments and omitted herein.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch device comprising:

a cap;

a board disposed opposite to the cap;

a first returning member disposed between the cap and the board, the first returning member comprising a magnet member and a magnetic member for providing a magnetic force; and a second returning member disposed between the cap and the board for providing an elastic force, the magnet member being spaced apart from the magnetic member at a maximum distance when deformation of the second returning member reaches to a maximum value;

wherein when the cap is released at a lowest position, the cap moves upward via the elastic force and then arrives and stays at a highest position via the magnetic force.

2. The keyswitch device of claim 1, wherein when the magnet member is in contact with the magnetic member, the second returning member does not deform.

3. The keyswitch device of claim 1 further comprising:

a main support structure comprising a first main frame and a second main frame, the first main frame and the second main frame being disposed between the cap and the board.

4. The keyswitch device of claim 3, wherein the main support structure is selected from a scissor support structure, a butterfly support structure or a link bar structure.

5. The keyswitch device of claim 3 further comprising:

at least one auxiliary support structure adjacent to the main support structure, the at least one auxiliary support structure comprising two auxiliary frames, the two auxiliary frames being disposed between the cap and the board.

6. The keyswitch device of claim 5, wherein the second returning member is a protruding point and protrudes from the at least auxiliary support structure toward one of the cap and the board, and the second returning member abuts against the one of the cap and the board during the process of the cap being pressed to the lowest position, so as to make the at least auxiliary support structure structurally interfere with the one of the cap and the board for deforming the at least one auxiliary support structure to generate the elastic force.

7. The keyswitch device of claim 5, wherein the first returning member is disposed between the first main frame and the second main frame, and the second returning member is disposed between the two auxiliary frames.

8. The keyswitch device of claim 5, wherein the second returning member is disposed between the first main frame and the second main frame, and the first returning member is disposed between the two auxiliary frames.

9. The keyswitch device of claim 5, wherein the auxiliary support structure is selected from a scissor support structure, a butterfly support structure or a link bar structure.

10. The keyswitch device of claim 5, wherein the cap has a long axis, a short axis, a first pressed region, and a second pressed region, an area of the first pressed region is larger than an area of the second pressed region, and the main support structure is disposed on the board corresponding to the first pressed region.

11. The keyswitch device of claim 10, wherein the auxiliary support structure is disposed on the board corresponding to the second pressed region.

12. The keyswitch device of claim 10, wherein one of the two auxiliary frames is transversely disposed in the first pressed region and the second pressed region along the long axis and is movably connected to the board and the cap, and the other one of the two auxiliary frames is transversely disposed in the first pressed region along the short axis and is movably connected to the board and the cap.

13. The keyswitch device of claim 3, wherein the second returning member is a protruding point and protrudes from the main support structure toward one of the cap and the board, and the second returning member abuts against the one of the cap and the board during the process of the cap being pressed to the lowest position, so as to make the main support structure structurally interfere with the one of the cap and the board for deforming the main support structure to generate the elastic force.

14. The keyswitch device of claim 1, wherein the magnetic member has a pivot portion, a magnetic portion, and a driving portion, the pivot portion passes through the magnetic member to extend from two lateral surfaces of the magnetic member, the magnetic portion and the driving portion are located at the two sides of the pivot portion, the magnetic portion is rotatably disposed on the board via the pivot portion, and the magnet member is disposed on the board and located under the magnetic portion.

15. The keyswitch device of claim 1, wherein the keyswitch device further comprises a circuit board, the magnetic member further has a protruding point, the circuit board has a switch corresponding to the protruding point; when the cap is pressed to the lowest position, the protruding point triggers the switch; the second returning member is disposed on the circuit board corresponding to the switch and is located under the first returning member; when the cap is pressed to the lowest position to make the protruding point trigger the switch, the second returning member deforms to generate the elastic force.

16. The keyswitch device of claim 1, wherein the cap has a long axis and a short axis, the second returning member is disposed at the long axis or the short axis and is located at a side of the first returning member, the first returning member is rotatably disposed on the board relative to an axial direction for providing the magnetic force to the cap, and the axial direction is parallel to the short axis or the long axis.

17. A keyswitch device comprising:

a cap;

a board disposed opposite to the cap;

a first returning member disposed between the cap and the board, the first returning member comprising a magnet member and a magnetic member for providing a magnetic force; and a second returning member disposed between the cap and the board for providing an elastic force;

wherein when the cap is released at a lowest position, the cap moves upward via the elastic force and then arrives and stays at a highest position via the magnetic force;

wherein when the magnet member is in contact with the magnetic member, the second returning member does not deform.

* * * * *